US006539549B1

(12) United States Patent
Peters, Jr.

(10) Patent No.: US 6,539,549 B1
(45) Date of Patent: Apr. 1, 2003

(54) SAFETY APPLICATOR GLOVE SYSTEM AND METHOD

(76) Inventor: George A. Peters, Jr., 12 Water St., North Andover, MA (US) 01845-2517

( * ) Notice: Subject to any disclaimer, the term of this patent is extended or adjusted under 35 U.S.C. 154(b) by 0 days.

(21) Appl. No.: 09/603,055

(22) Filed: Jun. 23, 2000

Related U.S. Application Data

(60) Provisional application No. 60/141,369, filed on Jun. 28, 1999.

(51) Int. Cl.[7] ..... A41D 13/08
(52) U.S. Cl. ..... 2/16; 15/227
(58) Field of Search ..... 2/16, 20, 158, 2/159, 160, 161.6, 161.7, 167, 170, 169; 15/227; 119/161; 294/1.3; 383/4

(56) References Cited

U.S. PATENT DOCUMENTS

| | | | | | |
|---|---|---|---|---|---|
| 3,327,320 | A | * | 6/1967 | Forsyth | 2/158 |
| 4,347,931 | A | | 9/1982 | Ginger et al. | |
| 4,430,759 | A | | 2/1984 | Jackrel | |
| 4,536,890 | A | | 8/1985 | Barnett et al. | |
| 4,545,841 | A | | 10/1985 | Jackrel | |
| 4,645,251 | A | * | 2/1987 | Jacobs | 294/1.3 |
| 4,788,733 | A | * | 12/1988 | Lerner | 15/104.94 |
| 4,845,781 | A | * | 7/1989 | Strickland et al. | 2/161 |
| 4,902,283 | A | | 2/1990 | Rojko et al. | |
| 4,937,881 | A | * | 7/1990 | Heise | 2/16 |
| 4,942,626 | A | | 7/1990 | Stern et al. | |
| 4,964,188 | A | * | 10/1990 | Olson | 15/227 |
| 5,020,159 | A | * | 6/1991 | Hellickson | 2/158 |
| 5,088,123 | A | | 2/1992 | MacDonald | |
| 5,186,322 | A | * | 2/1993 | Harreld et al. | 206/216 |
| 5,187,815 | A | | 2/1993 | Stern et al. | |
| 5,406,649 | A | * | 4/1995 | Bolembach | 2/158 |
| 5,438,708 | A | * | 8/1995 | Jacovitz | 2/161.6 |
| 5,542,125 | A | | 8/1996 | Zuckerwar | |
| 5,560,044 | A | | 10/1996 | Masley | |
| 5,566,405 | A | | 10/1996 | Masley | |
| 5,575,014 | A | | 11/1996 | Kane et al. | |
| 5,636,382 | A | | 6/1997 | Chopko et al. | |
| 5,661,853 | A | | 9/1997 | Wilmot | |
| 5,682,612 | A | * | 11/1997 | Schwarz | 2/161.6 |
| 5,704,670 | A | * | 1/1998 | Surplus | 294/24 |
| 5,715,841 | A | | 2/1998 | Utecht | |
| 5,732,716 | A | | 3/1998 | Utecht | |
| 5,734,992 | A | * | 4/1998 | Ross | 2/161.7 |
| 5,740,551 | A | | 4/1998 | Walker | |
| 5,771,490 | A | | 6/1998 | Reynolds et al. | |
| 5,806,668 | A | * | 9/1998 | Bixby | 206/216 |
| 5,813,409 | A | | 9/1998 | Leahy et al. | |
| 5,822,795 | A | | 10/1998 | Gold | |
| 5,822,796 | A | | 10/1998 | Harges, Jr. et al. | |

(List continued on next page.)

*Primary Examiner*—John J. Calvert
*Assistant Examiner*—Katherine Moran
(74) *Attorney, Agent, or Firm*—Kevin Mark Klughart

(57) ABSTRACT

A safety applicator glove system and method is disclosed that is particularly suitable for use in situations where insect repellent and the like must be applied to human skin without contaminating the hands of the person applying the insect repellent. The basic system disclosed includes a glove or mitten with an absorbent outer surface and an internal barrier lining to prevent penetration of liquid on the outer surface of the glove with the person's hand that has been inserted into the glove/mitten. Attached to the glove/mitten proximally to the hand entry point is a protective sleeve/gauntlet that may be extended over the surface of the glove and sealed to act as a containment vessel for the liquid-soaked glove. When retracted, this protective sleeve/gauntlet serves to prevent contamination of the person making use of the glove/mitten system. Various embodiments of the present invention may also be applied with advantage to the control of contamination associated with biohazardous waste, including but not limited to use with surgical gloves and the like.

9 Claims, 12 Drawing Sheets

(4 of 12 Drawing Sheet(s) Filed in Color)

U.S. PATENT DOCUMENTS 5,824,161 A 10/1998 Atkinson
5,862,916 A 1/1999 Utecht
5,864,883 A * 2/1999 Reo ..... 2/158
5,867,829 A * 2/1999 Hegoas et al. ..... 2/159
5,878,438 A 3/1999 Ragsdale
5,901,995 A * 5/1999 Tuvim et al. ..... 294/25
5,922,336 A * 7/1999 Tebbe ..... 424/402
5,924,130 A * 7/1999 Fragomeli ..... 2/16
5,924,137 A 7/1999 Gold
5,961,167 A * 10/1999 Gilley ..... 294/1.3
6,024,094 A 2/2000 Utecht
6,192,543 B1 * 2/2000 Lee ..... 15/118
6,058,882 A * 5/2000 Leutholt ..... 119/161
6,116,668 A * 9/2000 Carpol ..... 294/1.3
6,119,272 A * 9/2000 Tebbe ..... 2/161.7
6,203,080 B1 * 3/2001 Surplus ..... 294/1.3

* cited by examiner

SAFETY APPLICATOR GLOVE SYSTEM AND METHOD

CROSS REFERENCE TO RELATED APPLICATIONS

Applicant claims benefit pursuant to 35 U.S.C. §119 for Provisional Patent Application for "SAFETY APPLICATOR GLOVE SYSTEM AND METHOD", Ser. No. 60/141,369, filed Jun. 28, 1999 and submitted to the USPTO with Express Mail Label EM267140835US.

PARTIAL WAIVER OF COPYRIGHT

All of the material in this patent application is subject to copyright protection under the copyright laws of the United States and of other countries. As of the first effective filing date of the present application, this material is protected as unpublished material.

However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves

STATEMENT REGARDING FEDERALLY SPONSORED RESEARCH OR DEVELOPMENT

Not Applicable

REFERENCE TO A MICROFICHE APPENDIX

Not Applicable

FIELD OF THE INVENTION

The present invention relates generally to the safe application of insect repellent to human skin. The invention may lo also be utilized in situations where hazardous, toxic, and/or contaminated materials must be handled with safety.

While the field of the present invention is directed primarily to the field of insect repellant application, the present invention may be equally applied to other situations, such as application of sun-block (sun tanning lotion), protection of the hands while handling contaminated and/or oily materials, control of blood-borne contamination, and the like. Thus, the application of the present invention as disclosed is much broader than the insect repellant application field.

BACKGROUND OF THE INVENTION

Motivation

While malaria has been widely associated with transmission via mosquitoes and other insects, generally this disease has been treatable with traditional medical techniques. However, recent introduction of the West Nile virus into the Eastern United States has prompted a widespread concern that mosquito bites could in some circumstances be fatal due to transmission of this disease by the mosquito population. Therefore, a much greater emphasis on preventing mosquito bites is now present in the United States than previously due to this new biological threat. In an effort to reduce infection rates of West Nile virus, the present invention attempts as one of its objectives to improve the mechanism of application of insect repellant to human skin.

Insect Repellant Application

Currently there is no safe and effective method of applying insect repellent to human skin without also contaminating the hands of the person applying the insect repellent. In particular, the application of insect repellent to the skin of children can be problematic since it is possible for sprays and the like to accidentally burn a child's eyes or contaminate their hands during the application process.

Most insect repellents sold today are either in spray or lotion form, with the sprays being the most common. The industry currently has no safe method of applying the sprays to human skin during windy conditions or when children are the subjects of application. Furthermore, it is almost impossible for the person applying the spray to prevent contamination of their hands during the process. This condition makes handling food and the like problematic after application of the insect repellent.

Since many circumstance involving the use of insect repellents and the like involve situations where water is not available for hand washing, there is a significant issue of contamination after making use of insect repellent for either self-application or for application to another person.

Blood-Borne Contamination Control

Within the past 20 years there has been an increase in blood-borne diseases, including HIV (AIDS) as well as hepatitis and specifically hepatitis-C. These blood-borne diseases may be spread through contact with contaminated blood products. As a result, medical workers and persons administering first aid are trained to wear surgical gloves when treating patients who have open wounds or who are contaminated with blood products.

Given the widespread use of latex surgical gloves to solve this problem, there seems to be little thought in the industry as to the disposal problem created by contaminated surgical gloves. In traditional hospital settings the surgical gloves are disposed of in special medical waste containers. However, this approach is impractical or impossible in many first-aid situations, especially where lay persons are administering treatment to patients that have become injured. Examples of this include school settings, athletic events, and a wide variety of other scenarios where non-professionals must treat injured individuals.

DESCRIPTION OF THE PRIOR ART

While a wide variety of safety/utility glove/mitten configurations have been patented (see generally U.S. Pat. Nos. 4,347,931; 4,430,759; 4,536,890; 4,545,841; 4,902,283; 4,942,626; 5,088,123; 5,187,815; 5,542,125; 5,560,044; 5,566,405; 5,575,014; 5,636,382; 5,661,853; 5,715,841; 5,732,716; 5,740,551; 5,771,490; 5,813,409; 5,822,795; 5,822,796; 5,824,161; 5,862,916; 5,878,438; 5,924,137; 6,024,094), there appears to be no prior art directly applicable to the application of insect repellant and/or the reduction of contamination associated with human contact with unsafe materials.

The closest applicable prior art appears to include the following:

U.S. Pat. No. 4,347,931 issued to Rodney E. Ginger and Manfred Jungesblut on Sep. 7, 1982 for MITT. Here the inventor describes a disposable mitt pack comprising a bag-like mitt for accommodating the hand of the wearer with an outer impregnated surface material.

U.S. Pat. No. 4,902,283 issued to Josef Rojko, Maria Rojko, Norbert Leopoldi, and Roy A. Weidemann on Feb. 20, 1990 for ABSORBABLE CLEANING MITT FOR WIPING BABIES. Here the inventor describes a baby-wipe for wiping and cleaning babies.

U.S. Pat. No. 5,715,841 issued to Leo J. Utecht on Feb. 10, 1998 for PERSONAL PROTECTION APPARATUS WITH ADHESIVE. Here the inventor describes a personal protection apparatus including barrier members to protect the individual from infectious disease and the like.

U.S. Pat. No. 5,732,716 issued to Leo J. Utecht on Mar. 31, 1998 for PERSONAL PROTECTION METHOD. Here the inventor describes a personal protection method using a personal protection apparatus incorporating barrier members to protect the individual from infectious disease.

U.S. Pat. No. 6,024,094 issued to Leo J. Utecht on Feb. 15, 2000 for MEDICAL BIOHAZARD CLEAN UP METHOD AND DEVICE. Here the inventor describes a personal protection apparatus incorporating a method of disposal that minimizes potential for contamination by hazardous waste.

The applicant is not aware of any relevant prior art directly applicable to the present invention. While rubberized gloves and the like do exist in the prior art, there appears to be no glove or other applicator means available that is directly applicable for use in the safe application of insect repellant and the like. Furthermore, no system appears available to minimize the potential contamination associated with insect repellant or its harmful effects on the surrounding environment (car seats, furniture, etc.).

Finally, as applied to control of blood-borne contamination, the widespread use of surgical gloves and the like does not teach any method to control the contamination associated with the blood-borne diseases that may be present on a contaminated surgical glove. Both in the context of a hospital setting and in the context of unskilled first-aid application, there appears to be no teaching of any contamination control mechanism as described herein.

OBJECTS OF THE INVENTION

Accordingly, the objects of the present invention are (among others) to circumvent the deficiencies in the prior art and affect one or more of the following objectives:

1. Provide a method of applying insect repellent to human skin wherein the person applying the repellent does not contaminate their hands during the process.
2. Provide a safe method to apply insect repellent to children.
3. Provide a safe method of applying insect repellent during windy conditions.
4. Provide a mechanism to control contamination of blood-borne diseases in the context of first-aid procedures.
5. Provide an integrated method of controlling contamination from a variety of sources other than blood-borne contaminants.

While these objectives should not be understood to limit the teachings of the present invention, in general these objectives are achieved by the disclosed invention that is discussed in the following sections.

BRIEF SUMMARY OF THE INVENTION

Briefly, the invention teaches in a variety of embodiments a system and method permitting the safe application of insect repellent and the like to human skin, as well as a general system and method of contamination control.

As illustrated in FIG. 1 (100), the present invention solves the problems present in the prior art by permitting a glove/mitten (110) to be used by an agent (120) to apply the insect repellent (130) to the patient (140). The insect repellent (130) is first applied to an absorbent glove/mitten (110) and this article is then used in direct contact with human skin to apply the insect repellent. As illustrated in FIG. 2, the glove/mitten (111) has an internal barrier layer (116) to prevent the insect repellent from contacting the hand of the person applying the insect repellent. Note that the internal barrier layer (116) may conform to a human hand or be constructed in the form of a mitten. The key feature is that this layer is impermeable to contaminants.

Additionally, a protective sleeve/gauntlet (112, 113) is attached to the glove/mitten (111) to permit the glove/mitten (111) to be temporarily encapsulated during times of non-use as illustrated in FIG. 3. This permits the applicator glove/mitten (111) to be stored without potential for human contamination by the insect repellent. It is envisioned that the protective sleeve/gauntlet could have a child proof latch to prevent access by children, as well as permitting resealing by adults.

BRIEF DESCRIPTION OF THE DRAWINGS

The file of this patent contains at least one drawing executed in color. Copies of this patent with color drawing will be provided by the Patent and Trademark Office upon request and payment of the necessary fee.

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
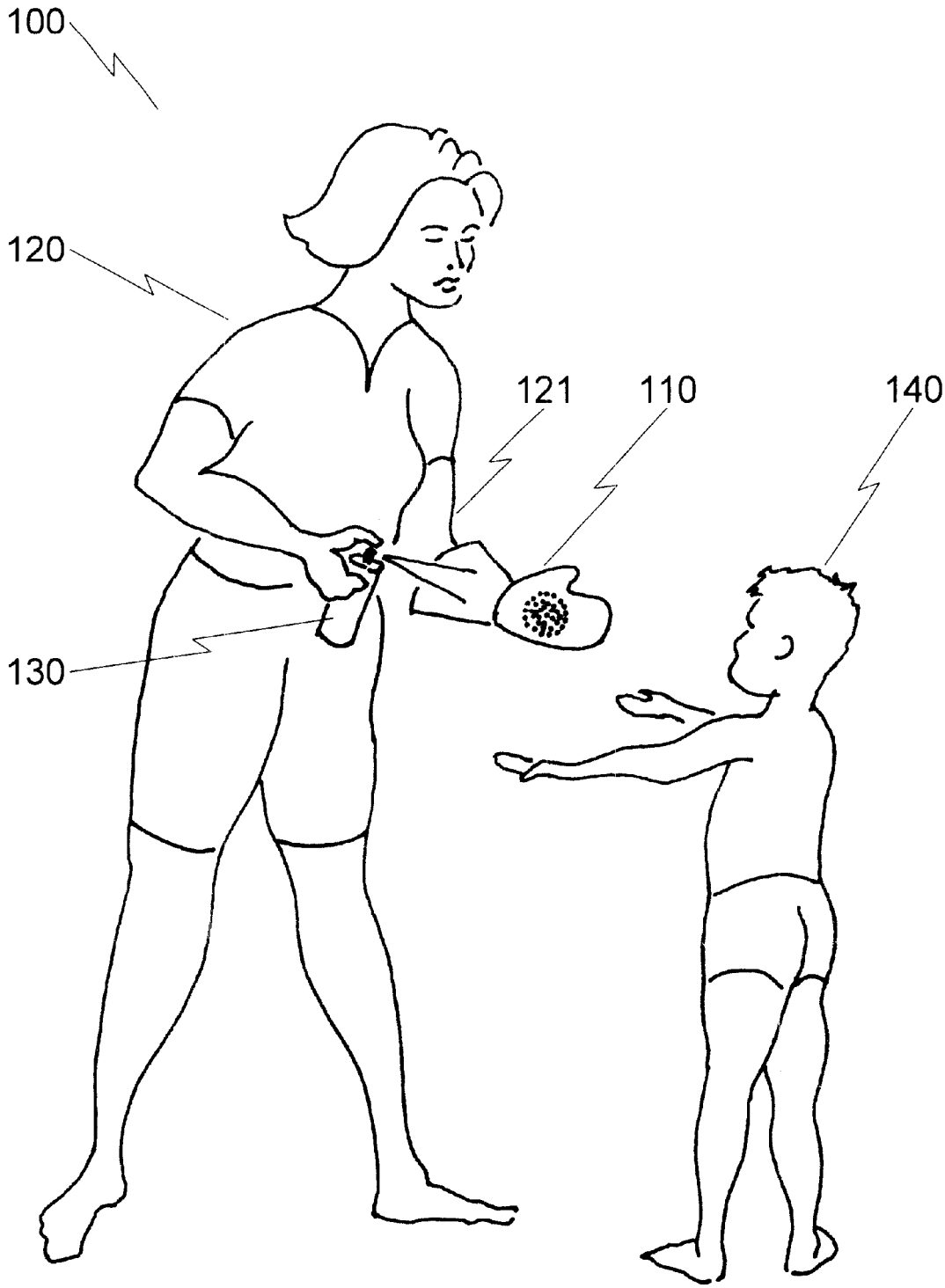
FIG. 1 illustrates an exemplary application of the present invention in the context of insect repellant application.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a SAFETY APPLICATOR GLOVE SYSTEM AND METHOD. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

As mentioned previously, the system context used herein to describe the present invention will be that of application of insect repellant. However, nothing in the scope of the present invention limits application of these teachings to this particular application. The present invention may be utilized in any situation where there is a need to protect human hands from contamination.

System Overview

Figure 2:
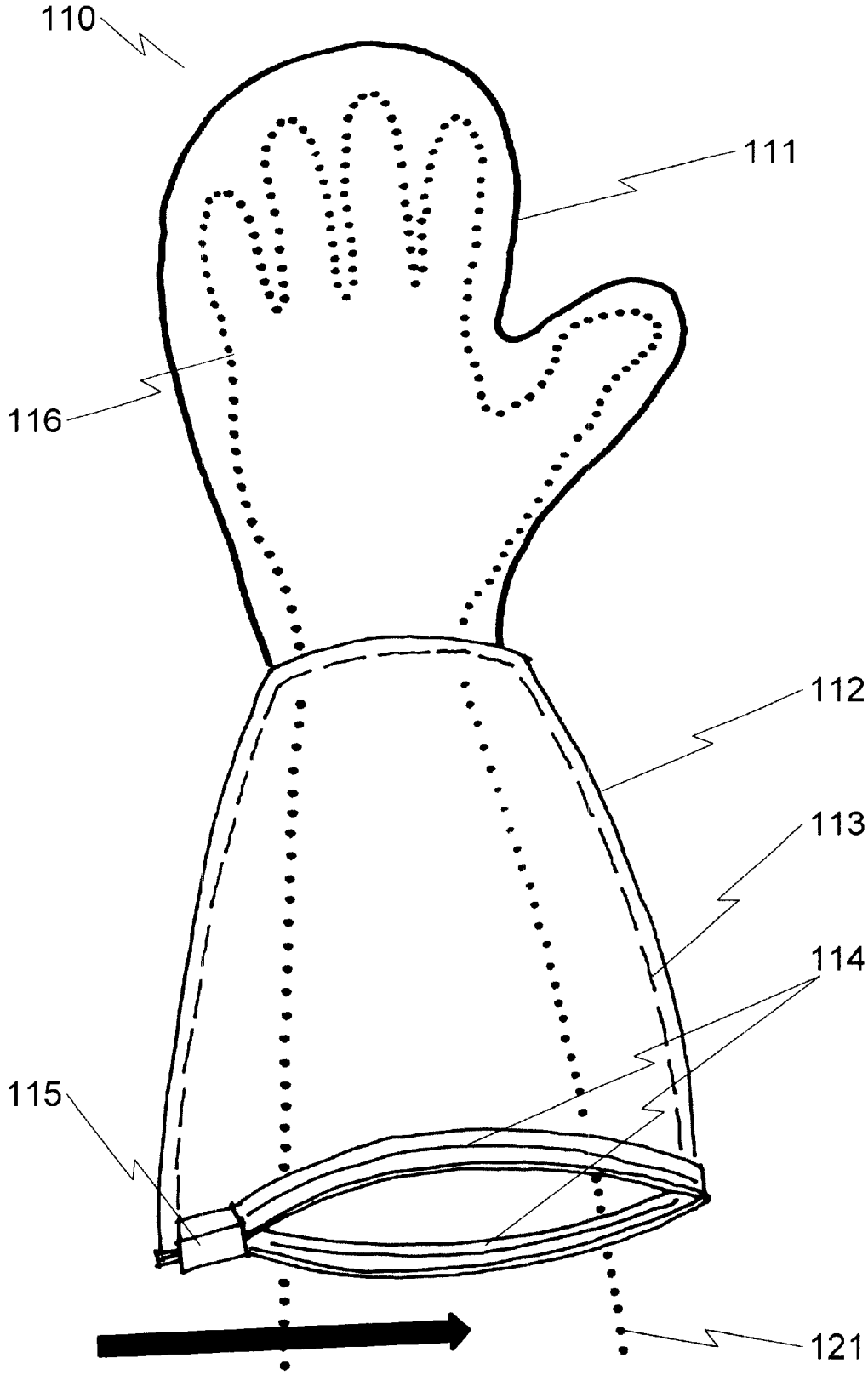
FIG. 2 illustrates an exemplary embodiment of the present invention configured for use as an insect repellant applicator.
Figure 3:
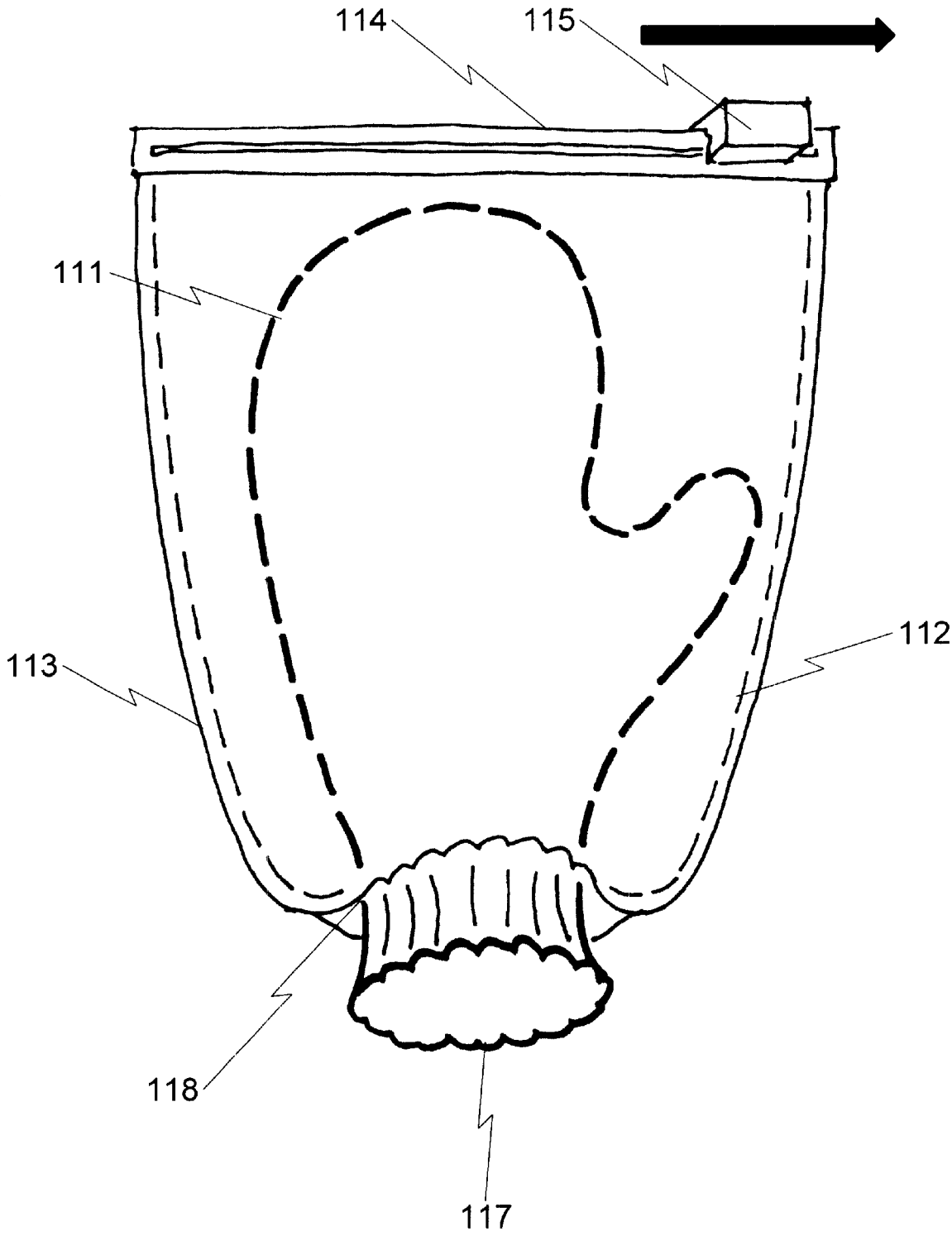
FIG. 3 illustrates an exemplary embodiment of the present invention configured in the storage mode of operation.

Referencing FIG. 2, the present invention (110) may be described by this exemplary embodiment in which a glove/mitten (111) having a substantially absorbent outer surface is attached to a protective sleeve/gauntlet (112, 113) (here depicted as a resealable plastic bag). Note that a variety of exemplary embodiments may use duct tape to affect this connection, although sewing or any other suitable means of fastening is acceptable. The protective sleeve/gauntlet generally comprises a barrier outer layer (112) that is impregnable and optionally an inner cloth layer (113) to provide durability in packaging when the invention is stored for non-use.

It is envisioned that the glove/mitten should have a protective barrier (116) inside the glove/mitten (111) to prevent the insect repellent from contacting the skin of the applicator's hand (121). As illustrated in FIG. 2, insertion of the applicator's hand in this scenario isolates the applicator's hand from any contamination/insect repellent within the confines of the protective sleeve/gauntlet.

GENERAL CONSTRUCTION

While a variety of construction method are available for the present invention, one of the best mode embodiments incorporates a glove/mitten having 1. an outer surface (111) that is optionally substantially absorbent;
2. a conforming hand internal surface (116) being constructed in a hand or mitten configuration;
3. a hand entry point (118);
4. a barrier lining between the outer surface (111) and the internal surface (116); and
5. a protective sleeve/gauntlet having an attachment point (118) and a resealable distal edge (114).

In this configuration the protective sleeve/gauntlet attachment point (118) is substantially connected to the hand entry point (117) and the protective sleeve/gauntlet (112, 113) may be extended to cover the glove/mitten (111), permitting the distal edge (114) to be sealed to substantially encapsulate the absorbent outer surface of the glove/mitten. To put the glove/mitten into service, the protective sleeve/gauntlet may be retracted as illustrated in FIG. 6 to uncover the glove/mitten (111), permitting the absorbent outer surface to be exposed, coated with an application liquid, and applied to human skin via the use of the glove/mitten.

OPERATION OF THE PRESENT INVENTION

Figure 6:
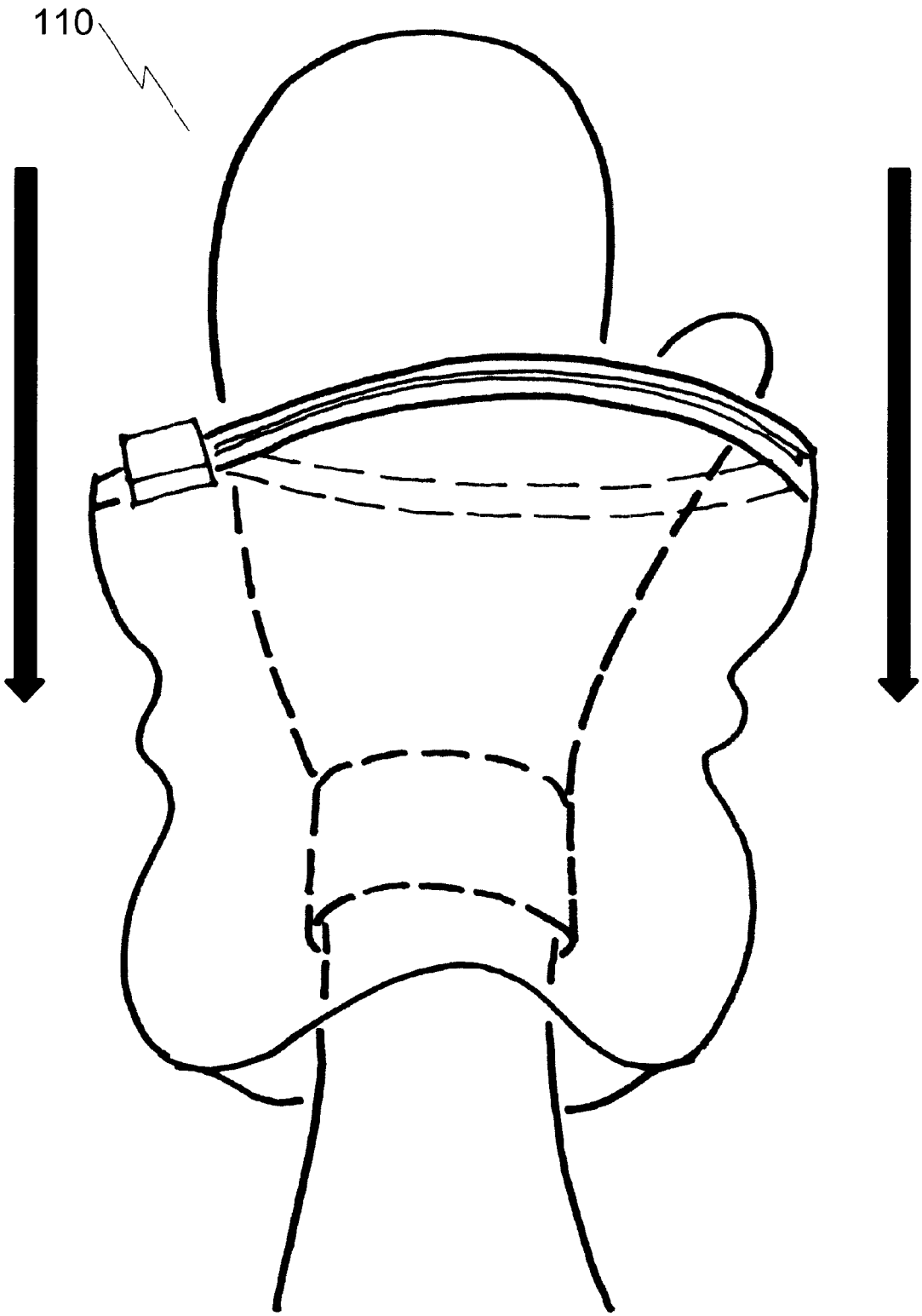
FIG. 6 illustrates an exemplary embodiment of the present invention showing deployment of the protective sleeve/gauntlet to permit exposure of the glove/mitten assembly.

As illustrated in FIG. 6, when the protective sleeve/gauntlet is retracted, the glove/mitten is exposed and may then be soaked/coated with insect repellent for later application to human skin. Note in FIG. 6, by retracting the protective sleeve/gauntlet the applicator's hand is further protected from contamination by the applicator glove/mitten. This feature is useful in situations where the insect repellent is sprayed onto the applicator glove. Here it can be seen that the protective sleeve/gauntlet permits the entire forearm of the applicator to be shielded from insect repellent spray.

It is significant to note that that the glove/mitten outer surface (111) may be optionally pre-soaked with insect repellant to affect application of same to human skin. One skilled in the art will recognize with this feature permits specifically tailored 'insect mitts' to be manufactured that are pre-impregnated with insect repellant and thus permit easy application of insect repellant to human skin in a wide variety of adverse conditions. This type of pre-soaked insect application methodology is especially advantageous in windy conditions or conditions in which the potential of cross-contamination of other persons and/or materials (food, etc.) is high. Pre-impregnation of the 'insect mitt' embodiments may take the form of traditional insect repellant or a wide variety of gels that may be impregnated beneath the glove/mitten surface (111).

The exemplary embodiment may also be used to store separate canisters of insect repellent during times of non-use. It is specifically envisioned that a child resistant safety snap can be used in the sealing of the protective sleeve/gauntlet.

Preferred Materials/construction

It is preferred that the outside glove/mitten material be soft cloth to both absorb spray and be gentle to the skin of a child. The inside of the glove/mitten can be made of durable plastic or non-absorbable material that will not allow insect repellent through to the skin of the hand.

Typical sizing for the system would be 5 inches wide by 10 inches long, with a preferred embodiment having the thumb and pointing finger separated so as to have a better guide to apply insect repellent to sensitive areas of human skin. One skilled in the art will quickly recognize that these sizing and configuration recommendations may be modified consistent with the teachings of the present invention to affect a wide variety of other applications.

Generally, it is thought best to enclose the glove/mitten in plastic so that it may be opened and refastened using Velcro™ brand fasteners, a ZIP-LOC™ style fastener (114), and/or a child safety snap to limit access by children. While preferred embodiments illustrated in FIGS. 2–7 show the system containing a slidable ZIP-LOC™ style slide (115), the present invention does not necessarily require this to achieve its general purpose.

It is thought that the system can be enclosed using a decorative cloth outer layer (113) that would permit easy folding into any handbag, gym bag, backpack, or the like. However, many embodiments of the present invention may be constructed with only the gauntlet barrier layer (112).

Exemplary Insect Repellant Application Method

Figure 4:
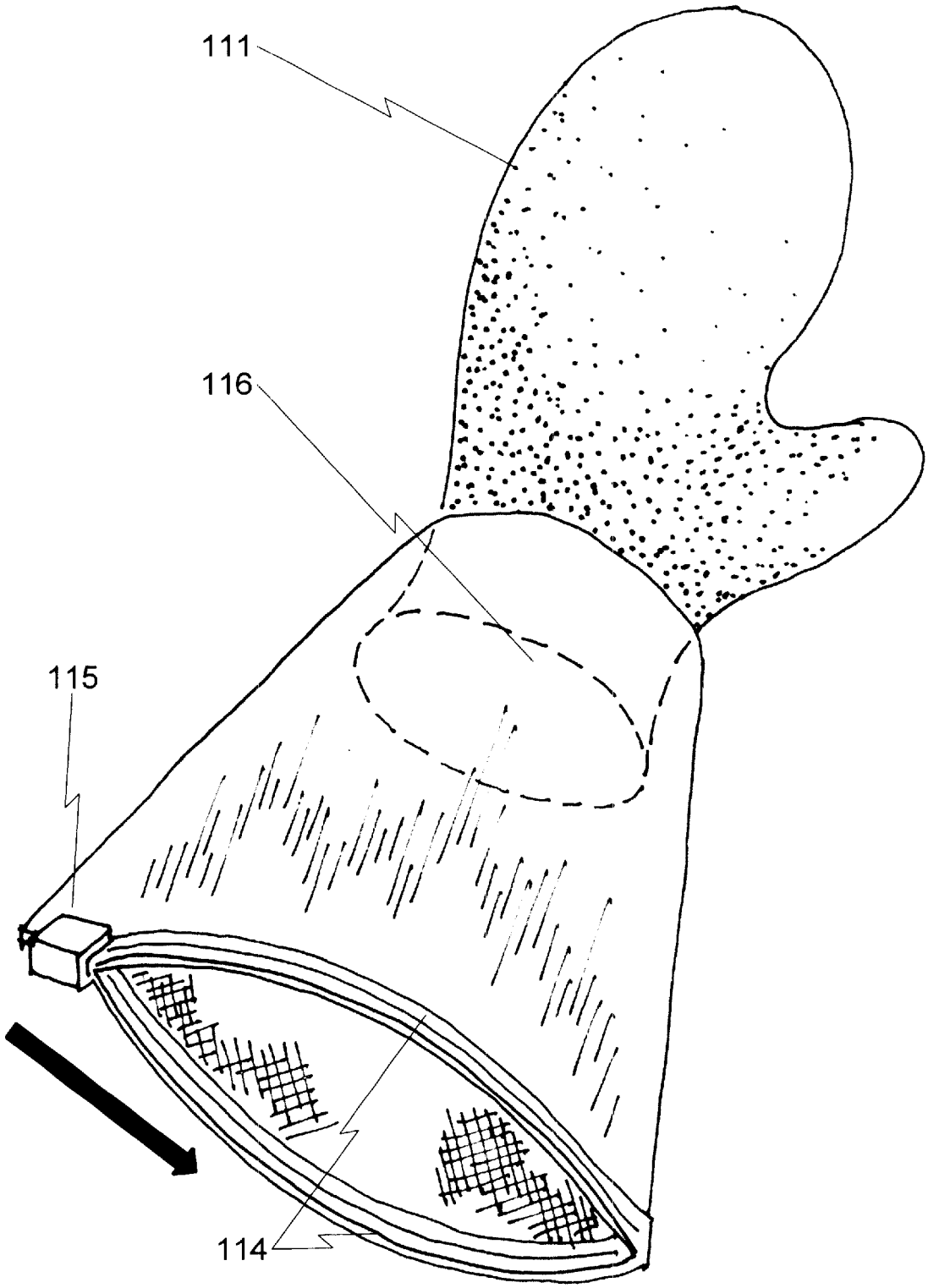
FIG. 4 illustrates an exemplary embodiment of the present invention illustrating a side view of the embodiment.
Figure 5:
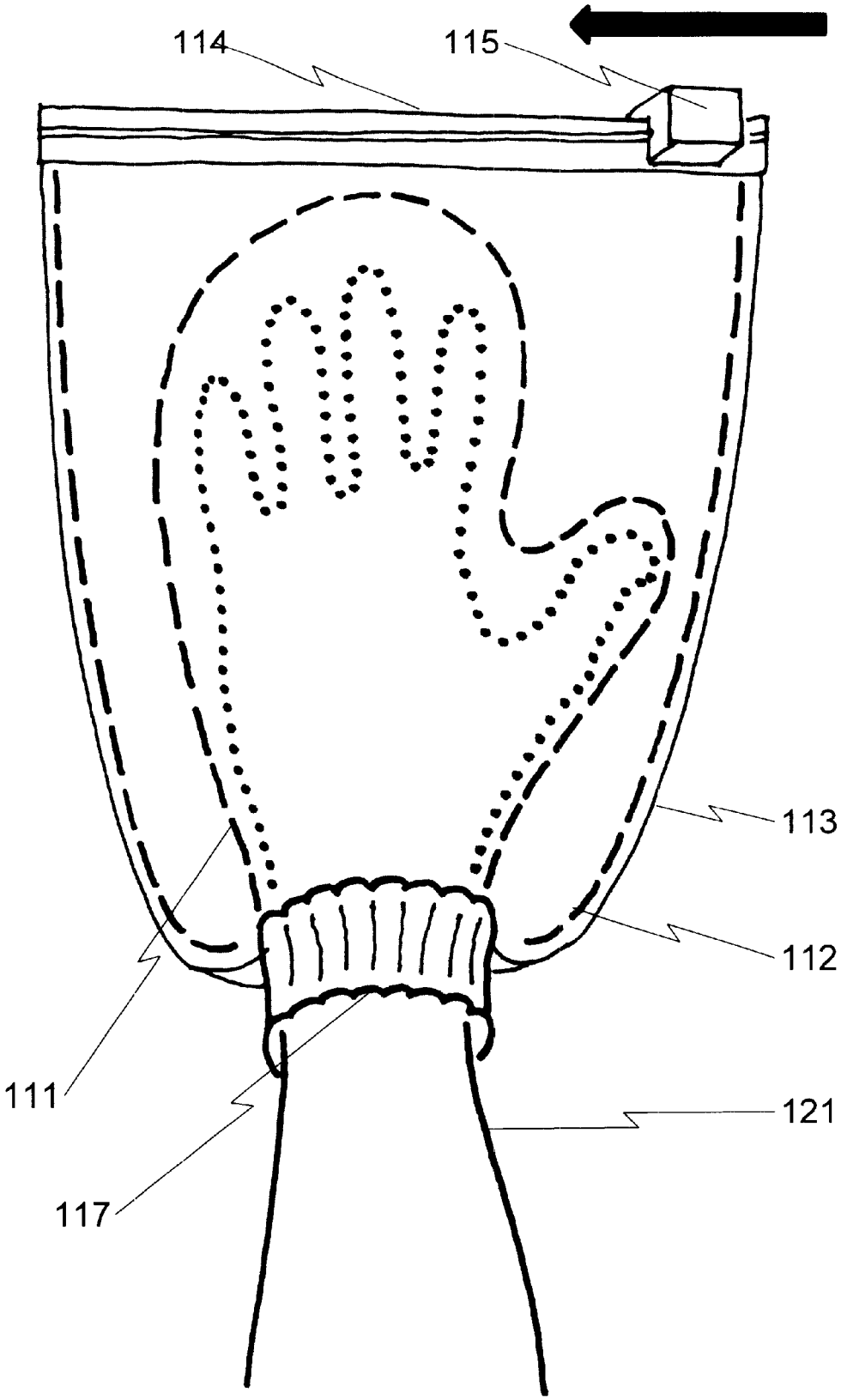
FIG. 5 illustrates an exemplary embodiment of the present invention showing placement of the user's hand prior to operation of the invention.
Figure 8:
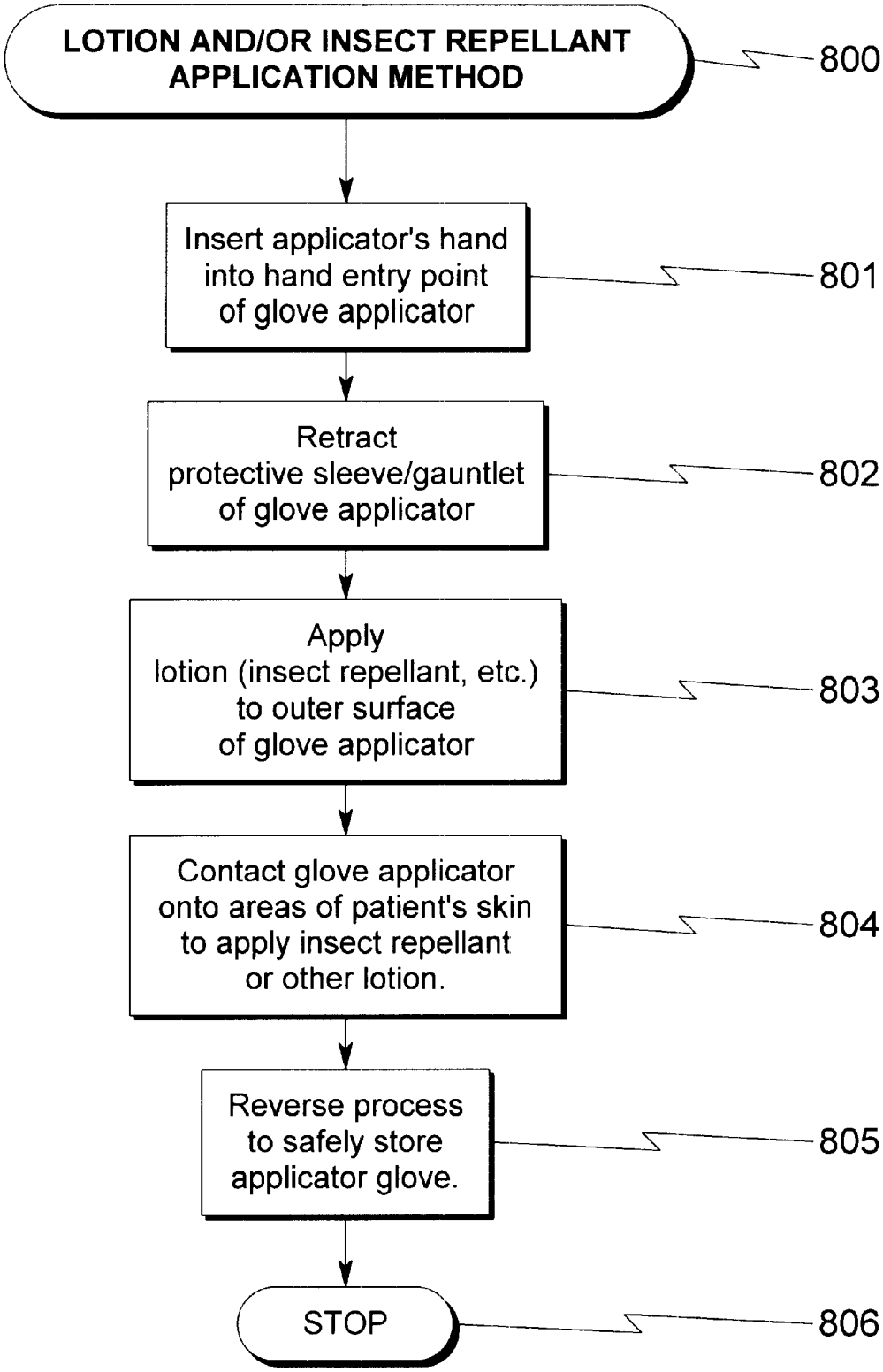
FIG. 8 illustrates an exemplary flowchart illustrating the method of application using the present invention.

As illustrated in the exemplary flowchart of FIG. 8, the present invention may be advantageously applied to situations in which insect repellant is to be applied to a human subject. The general method involves the following steps:

1. Utilizing the previously described safety glove applicator as illustrated in FIG. 4 (800).
2. Inserting applicator's hand into the hand entry point of the glove applicator (801) as illustrated in FIG. 5 (117).
3. Retracting the protective sleeve/gauntlet of the glove applicator (802) as illustrated in FIG. 6.
4. Applying insect repellent to the outer surface of the glove applicator (803).
5. Contacting the glove applicator onto areas of human skin to apply said insect repellent (804).
6. Reversing steps 1-5 as necessary to affect storage of the glove applicator system (805).

The glove applicator may be resealed and stored by reversing the above steps.

Note that this technique may also be used to apply other lotions and the like to humans and/or animate and inanimate objects. For example, it may be equally applied to the use of sunscreen, medicine, car wax, or other liquids/gels to humans and other animate and inanimate objects. While the composition of the glove/mitten may change based on the application, the basic concept of having some form of barrier within the glove/mitten combined with a retractable/resealable sleeve/gauntlet will be a common theme in all these alternate embodiments.

Exemplary Medical Embodiments

Overview

The present invention is not limited to use in the application of insect repellent. The concept of the present invention may also be of use in situations where the glove/mitten comes in contact with hazardous waste and the like and must be sealed/encapsulated prior to disposal. For example, the presently disclosed technique could be equally applied to gloves used in hazardous biomedical applications, where the potential for biohazard contamination is high. In this application the glove/mitten may not necessarily be absorbent, but the concept of the resealable protective sleeve/gauntlet may be advantageously used to seal the glove/mitten for temporary safekeeping until the entire unit can be disposed of in a safe manner.

Exemplary Applications

This embodiment of the present invention has numerous applications, but may be particularly advantageous in situations where emergency medical teams treat wounded individuals in the field. Here there is a significant concern with blood-borne contaminants. Therefore, it would be advantageous to have a system that permits the contaminated glove/mitten to be sealed prior to disposal. This would prevent contamination of both the person and his surrounding medical equipment where there was no method of properly disposing of the biohazardous material.

Figure 7:
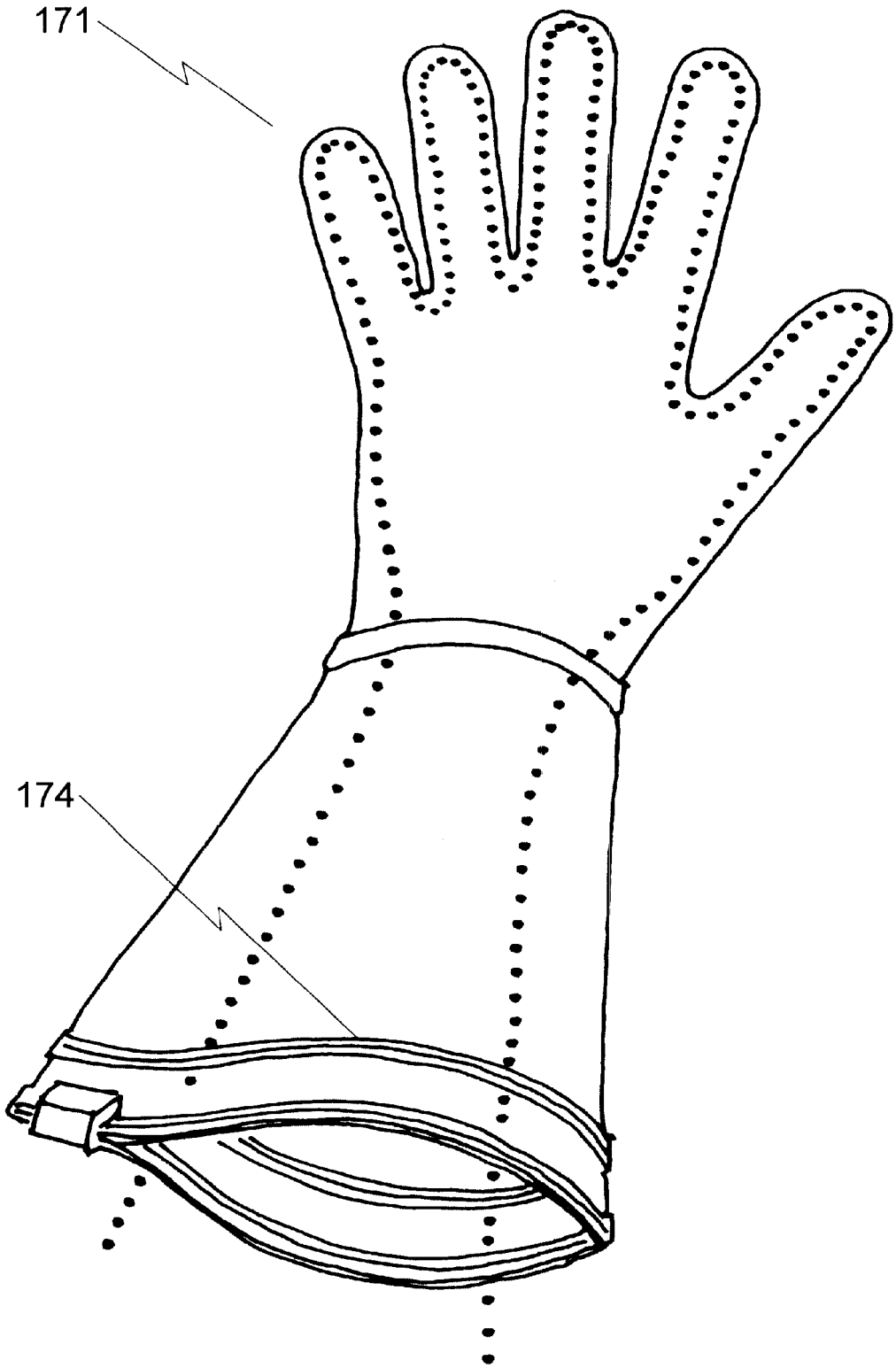
FIG. 7 illustrates an exemplary embodiment of the present invention as applied to surgical gloves and the control of blood-borne contamination.

A clear example of how this may be applied to the medical industry is in the area of surgical gloves. Typically surgical gloves are made of latex rubber or the like to provide a conformal fit to the medical doctor or technician. The addition of a retractable sleeve/gauntlet with resealable end as illustrated in FIG. 7 permits the medical personnel to remove the glove without contaminating his/her other hand. Furthermore, once sealed the latex glove/retractable sleeve/gauntlet assembly (171) may be safely disposed of without concern that the package will pose a biohazard danger to persons handling the medical waste. To further enhance the safety of this device, a secondary sealing mechanism (174) may be implemented using additional ZIP-LOC™ or other fastening/sealing means. This provides additional assurance that no contamination contained within the encapsulated sleeve/gauntlet will be allowed to escape this enclosure.

Additionally, since the sleeve/gauntlet may be used to contain contaminated materials (bandages, blood-soaked clothing, etc.), these materials may be encapsulated within the sealed portion of the sleeve/gauntlet for temporary storage prior to final disposal. This provides a significant advantage in first-aid situations where there may be no easy access to a medical waste disposal container. The sleeve/gauntlet enclosure may provide this temporary storage and thus prevent contamination of humans and others by blood from an injured patient.

While the preferred material for constructing the glove/mitten portion of the invention in this application is surgical latex rubber, it is also possible to construct the system entirely of commercial bag plastic since in many circumstances the tight fit of surgical latex rubber is not necessary. This would apply in situations such as first-aid and the like, or any other situation where temporary contamination control is desired.

Exemplary Industrial Embodiments

The present invention may also be advantageously applied to situations where industrial contamination needs to be controlled. For example, one variation of the present invention may be constructed entirely of a wide variety of plastic instead of surgical latex rubber. In this configuration the hands of the person using the system are protected from the elements, and as such this configuration is useful in automobile repair situations (checking the oil, replacement of car batteries, etc.) where there is a substantial likelihood of hand contamination during the repair/inspection process. The useful aspect of the present invention in these situations is that the glove/mitten assembly may be resealed and reused on numerous occasions, while eliminating the need for hand washing and other cleanup measures once the repairs/inspection are completed. These features are not available with any of the prior art glove/mitten configurations.

Actual Reduction to Practice

Figure 9:
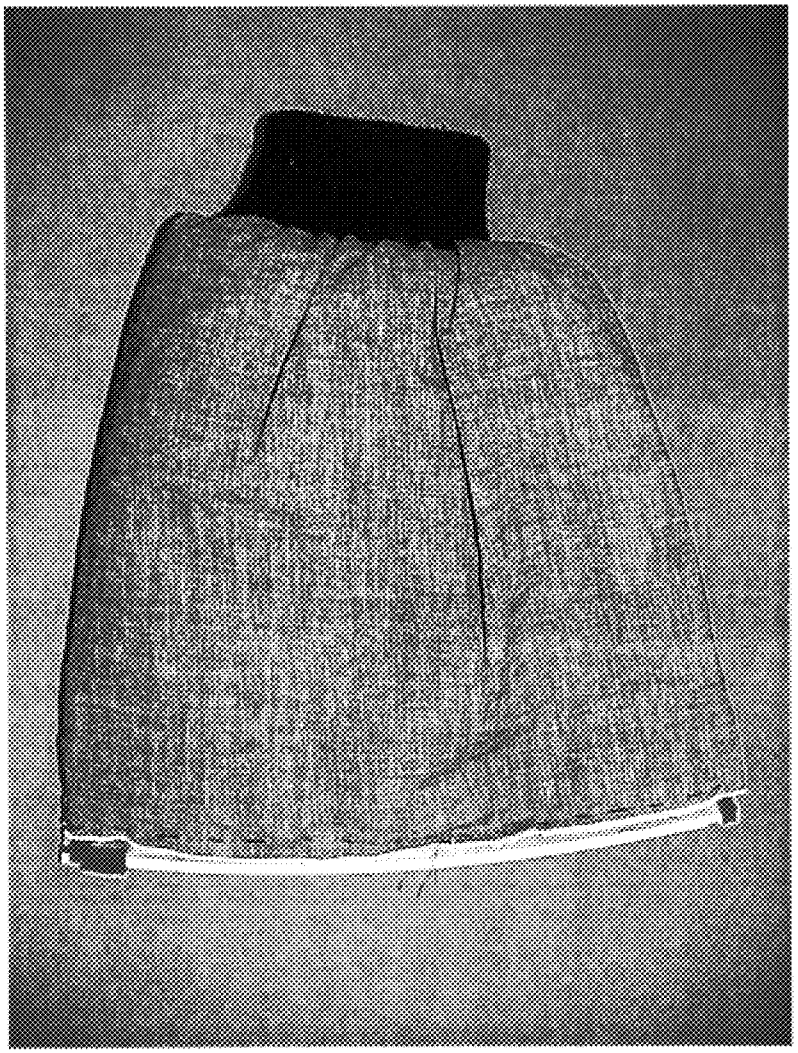
FIG. 9 illustrates an exemplary embodiment of the present invention reduced to practice and secured for storage.
Figure 10:
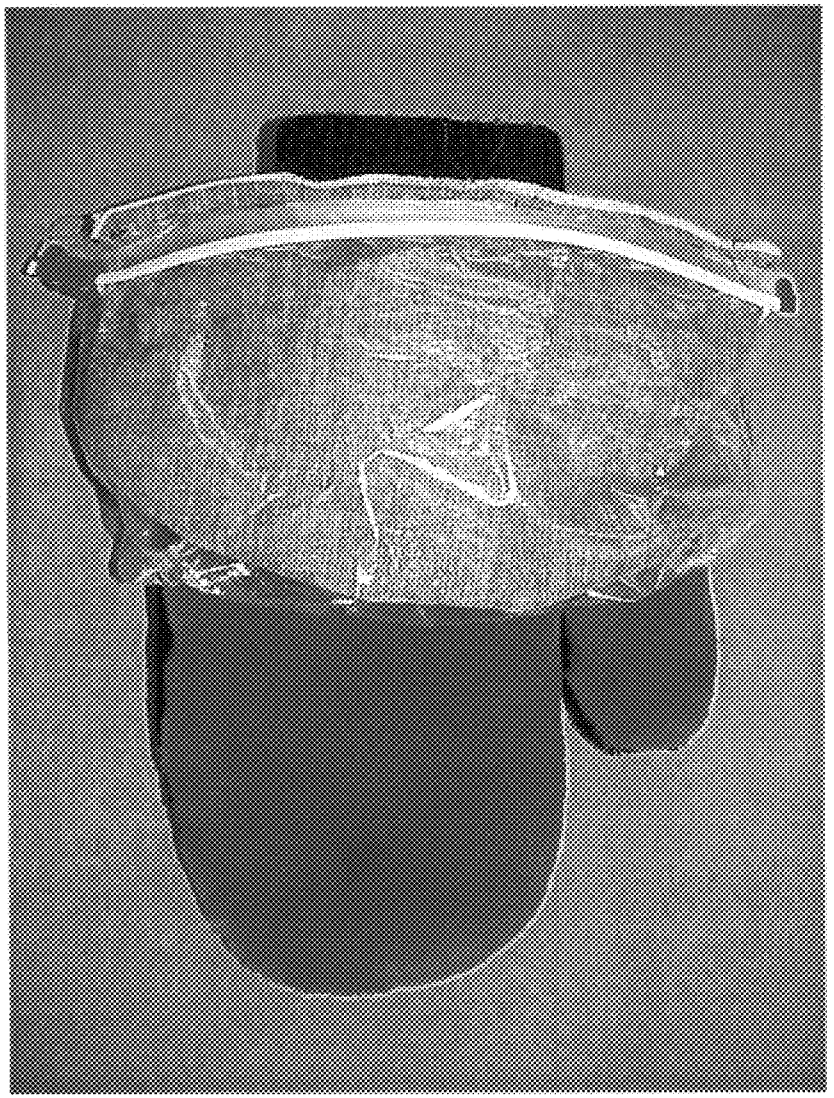
FIG. 10 illustrates an exemplary embodiment of the present invention reduced to practice showing partial retraction of the protective sleeve/gauntlet.
Figure 11:
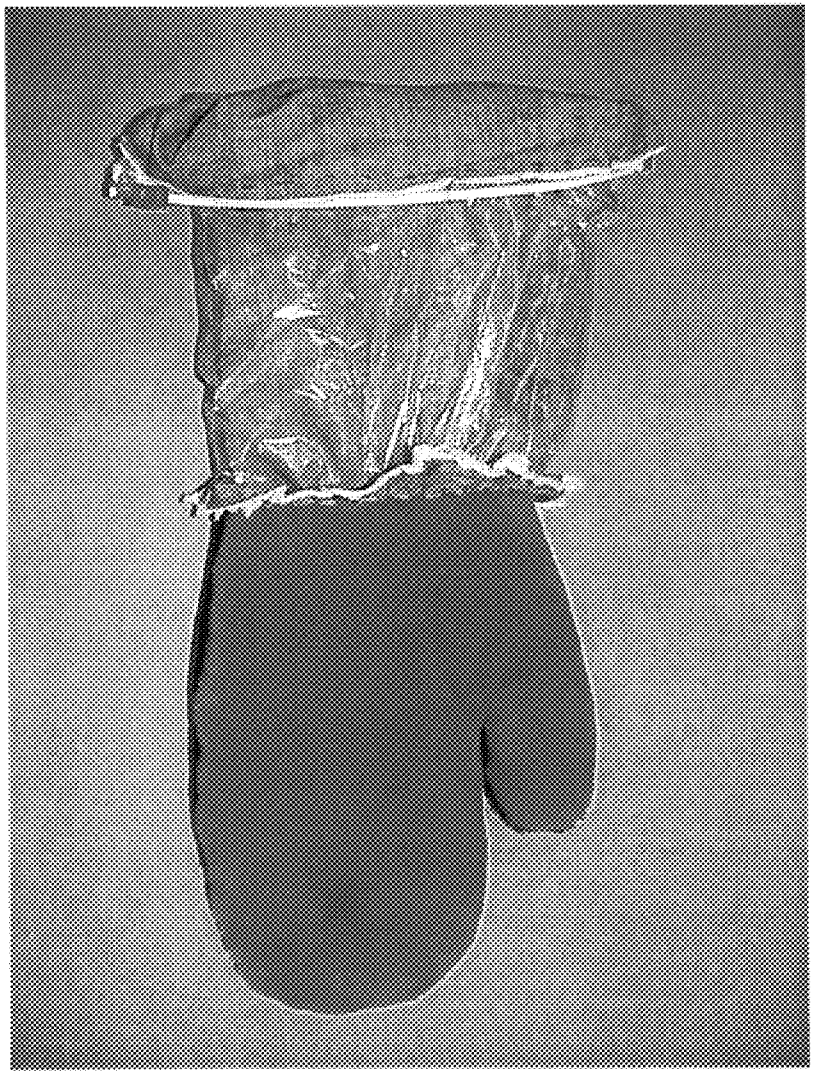
FIG. 11 illustrates an exemplary embodiment of the present invention reduced to practice showing partial retraction of the protective sleeve/gauntlet.
Figure 12:
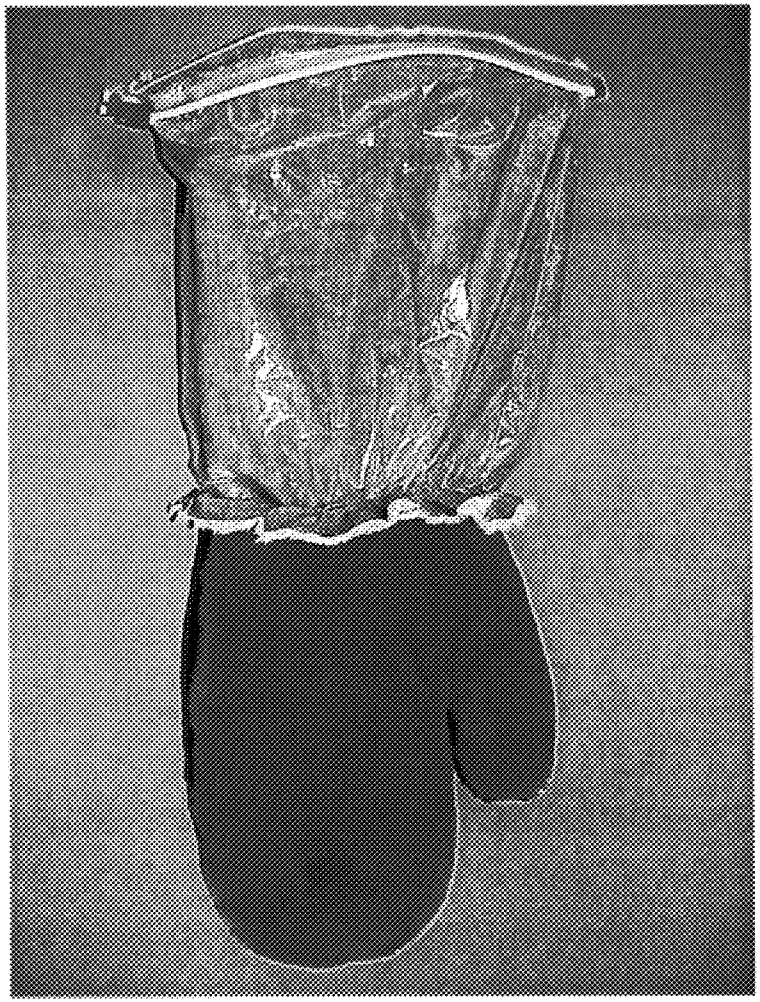
FIG. 12 illustrates an exemplary embodiment of the present invention reduced to practice showing full retraction of the protective sleeve/gauntlet.

FIGS. 9–12 illustrate a preferred embodiment of the present invention. FIG. 9 illustrates the invention with the applicator glove secured. FIGS. 10 and 11 provide illustrations of the invention embodiment with the protective sleeve/gauntlet partially deployed. FIG. 12 illustrates the preferred embodiment with the protective sleeve/gauntlet fully deployed.

It is significant to note that the applicator glove may have different colors on each of its faces. In this preferred configuration, different lotions and/or types of insect repellant may be applied to each of the faces, and thus one applicator glove can service a variety of different tasks simultaneously.

Conclusion

A safety applicator glove system and method is disclosed that is particularly suitable for use in situations where insect repellent and the like must be applied to human skin without contaminating the hands of the person applying the insect repellent. The basic system disclosed includes a glove or mitten with an absorbent outer surface and an internal barrier lining to prevent penetration of liquid on the outer surface of the glove with the person's hand that has been inserted into the glove/mitten. Attached to the glove/mitten proximally to the hand entry point is a protective sleeve/gauntlet that may be extended over the surface of the glove and sealed to act as a containment vessel for the liquid-soaked glove. When retracted, this protective sleeve/gauntlet serves to prevent contamination of the person making use of the glove/mitten system.

The use of a substantially absorbent glove with a barrier lining, in conjunction with a resealable protective sleeve/gauntlet has been shown to provide a safe and effective method of applying insect repellent without contaminating the hands of the person applying the repellent. This method has also been demonstrated to be a safe and effective method of applying insect repellent to children and to persons in windy conditions.

Various embodiments of the present invention may also be applied with advantage to the control of contamination associated with biohazardous waste, including but not limited to use with surgical gloves and the like. It is envisioned that this would be extremely effective in controlling biohazard contamination surrounding emergency medical support teams, first aid kits, and the like. In these circumstances, the glove/mitten being used may or may not be absorbent, depending on the application needs.

Although a preferred embodiment of the present invention has been illustrated in the accompanying Drawings and described in the foregoing Detailed Description, it will be understood that the invention is not limited to the embodiments disclosed, but is capable of numerous rearrangements, modifications, and substitutions without departing from the spirit of the invention as set forth and defined by the following claims.

What is claimed is:

1. A safety glove system comprising:

(a) a glove/mitten, said glove/mitten having a substantially absorbent outer surface, a conforming hand internal surface, a hand entry point, and a barrier lining between said outer surface and said internal surface; and (b) a protective sleeve/gauntlet, said protective sleeve/gauntlet having an attachment point and a resealable distal edge;

wherein said protective sleeve/gauntlet attachment point is substantially connected to said hand entry point;

said protective sleeve/gauntlet may be extended to cover said glove/mitten, permitting said distal edge to be sealed to substantially encapsulate said absorbent outer surface;

said protective sleeve/gauntlet may be retracted to uncover said glove/mitten, permitting said absorbent outer surface to be exposed, coated with an application liquid, and applied to human skin via the use of said glove/mitten.

2. The safety glove system of claim 1 wherein said protective sleeve/gauntlet further comprises a barrier layer and protective outer layer.

3. The safety glove system of claim 1 wherein said protective glove/mitten is presoaked with insect repellant.

4. A safety glove system comprising:

(a) a glove/mitten, said glove/mitten having an outer surface, a conforming hand internal surface, a hand entry point, and a barrier lining between said outer surface and said internal surface; and (b) a protective sleeve/gauntlet, said protective sleeve/gauntlet having an attachment point and a resealable distal edge;

wherein said protective sleeve/gauntlet attachment point is substantially connected to said hand entry point;

said protective sleeve/gauntlet may be extended to cover said glove/mitten, permitting said distal edge to be sealed to substantially encapsulate said outer surface;

said protective sleeve/gauntlet may be retracted to uncover said glove/mitten, permitting said outer surface to be exposed to contamination.

5. The safety glove system of claim 4 wherein said protective sleeve/gauntlet further comprises a barrier layer and protective outer layer.

6. The safety glove system of claim 4 wherein said glove/mitten is constructed of surgical latex rubber.

7. The safety glove system of claim 4 wherein said glove/mitten is constructed of bag plastic.

8. A method for safely applying insect repellent comprising:

(a) utilizing a glove/mitten, said glove/mitten having a substantially absorbent outer surface, a conforming hand internal surface, a hand entry point, and a barrier lining between said outer surface and said internal surface;

(b) protecting said glove/mitten with a protective sleeve/gauntlet, said protective sleeve/gauntlet having an attachment point and a resealable distal edge;

(c) inserting applicator's hand into said hand entry point;

(d) retracting said protective sleeve/gauntlet;

(e) applying insect repellent to said outer surface;

(f) contacting said glove/mitten onto areas of human skin to apply said insect repellent.

9. A method for safe disposal of surgical gloves comprising:

(a) utilizing a glove/mitten, said glove/mitten having an outer surface, a conforming hand internal surface, a hand entry point, and a barrier lining between said outer surface and said internal surface;

(b) protecting said glove/mitten with a protective sleeve/gauntlet, said protective sleeve/gauntlet having an attachment point and a resealable distal edge;

(c) covering said glove/mitten with said protective sleeve/gauntlet;

(d) sealing said protective sleeve/gauntlet over said glove/mitten;

(e) removing a user's hand from said hand entry point.

* * * * *